United States Patent [19]

Smithers

[11] 4,041,676

[45] Aug. 16, 1977

[54] APPARATUS FOR PACKING STRIPS OF MATERIAL

[75] Inventor: James P. Smithers, Glen Ellyn, Ill.

[73] Assignee: Armour and Company, Phoenix, Ariz.

[21] Appl. No.: 608,590

[22] Filed: Aug. 28, 1975

Related U.S. Application Data

[60] Continuation of Ser. No. 458,764, April 8, 1974, which is a division of Ser. No. 262,656, June 14, 1972, abandoned.

[51] Int. Cl.[2] ..... B65B 35/30; B65B 63/00

[52] U.S. Cl. ..... 53/123; 53/159; 198/421

[58] Field of Search ..... 53/123, 147, 156–159, 53/196, 389, 393; 198/25, 34, 35, 42 S

[56] References Cited

U.S. PATENT DOCUMENTS

| | | | |
|---|---|---|---|
| 2,817,198 | 12/1957 | Crowley et al. | 53/123 X |
| 3,010,499 | 11/1961 | Dahms et al. | 53/123 X |
| 3,290,860 | 12/1966 | Rau | 53/184 |
| 3,353,329 | 11/1967 | Cloud et al. | 53/184 X |
| 3,452,504 | 7/1969 | Marshall | 53/29 |
| 3,537,230 | 11/1970 | Dorfmann | 53/159 X |
| 3,668,821 | 6/1972 | Benson et al. | 53/123 |

*Primary Examiner*—Robert Louis Spruill
*Attorney, Agent, or Firm*—Frank T. Barber; Carl C. Batz

[57] ABSTRACT

A method of packing strips of material such as bacon by feeding film over a rotating stepped roll, feeding strips or slices of the material onto the film over the steps of this roll, picking up the slices from the roll in shingled relationship with film interleaved between the slices, and then compacting the shingled strips by passing them from a conveyor driven at one speed to a conveyor driven at a slower speed. A machine is disclosed having mechanical and automatic controls for timing the respective functions in accordance with the operation of the slicer and for synchronizing the elements of the machine.

9 Claims, 24 Drawing Figures

APPARATUS FOR PACKING STRIPS OF MATERIAL

This is a continuation of Ser. No. 458,764 filed Apr. 8, 1974, which in turn is a division of application Ser. No. 262,656 filed June 14, 1972 now abandoned.

This invention relates to a method and machine for packing strips of material and more particularly to a method and machine for packing strips of bacon with a paper or other film material interleaved between the strips.

BACKGROUND

It is well known that when a package of bacon having slices or strips of bacon in shingled or stacked relation is stored in a refrigerator the slices stick together and are very difficult to separate. It seems that the fat on the surfaces of the bacon strip congeals and acts in the nature of an adhesive. It is difficult to get hold of a strip of bacon in such a package and even when one gets hold of a slice the slice tends to break up when an attempt is made to pull it from the remaining strips of the package.

One way in which the art has attempted to solve this problem is to put strips of waxed paper between the slices of bacon. To do this by hand is tedious and time consuming. The cost of the paper material and the labor involves has proved so great that the method is economically impracticable.

The art has further sought by mechanical means to place paper between the strips of bacon as they are packed. Attempts have been made to pack the bacon using a preformed strip of paper which has been placed in accordion fashion and place the bacon strips within the pleats. Such a machine is disclosed in the United States patent to Crowley et al U.S. Pat. No. 2,817,198. However, difficulties encountered in handling the bacon strips both in the placement of the bacon strips and in their assemblage in interleaved form are factors which it is believed has prevented such machines from coming into commercial use.

The problem is further complicated by the fact that modern slicing machines are customarily run at a high rate of speed which may be of the order of 1000 or 1500 slices per minute, and the handling of materials at this rate of speed brings additional problems.

Accordingly, it is an object of this invention to provide a method and machine for interleaving slices of bacon, sausages or other materials and particularly to provide methods and means for interleaving the slices or strips at a high rate of speed as they come from a commercial slicing machine. Other specific objects and advantages will be apparent as this specification proceeds.

DRAWINGS

One embodiment of the machine for accomplishing the purposes intended is illustrated in the accompanying drawings in which.

Figures 1, 3:
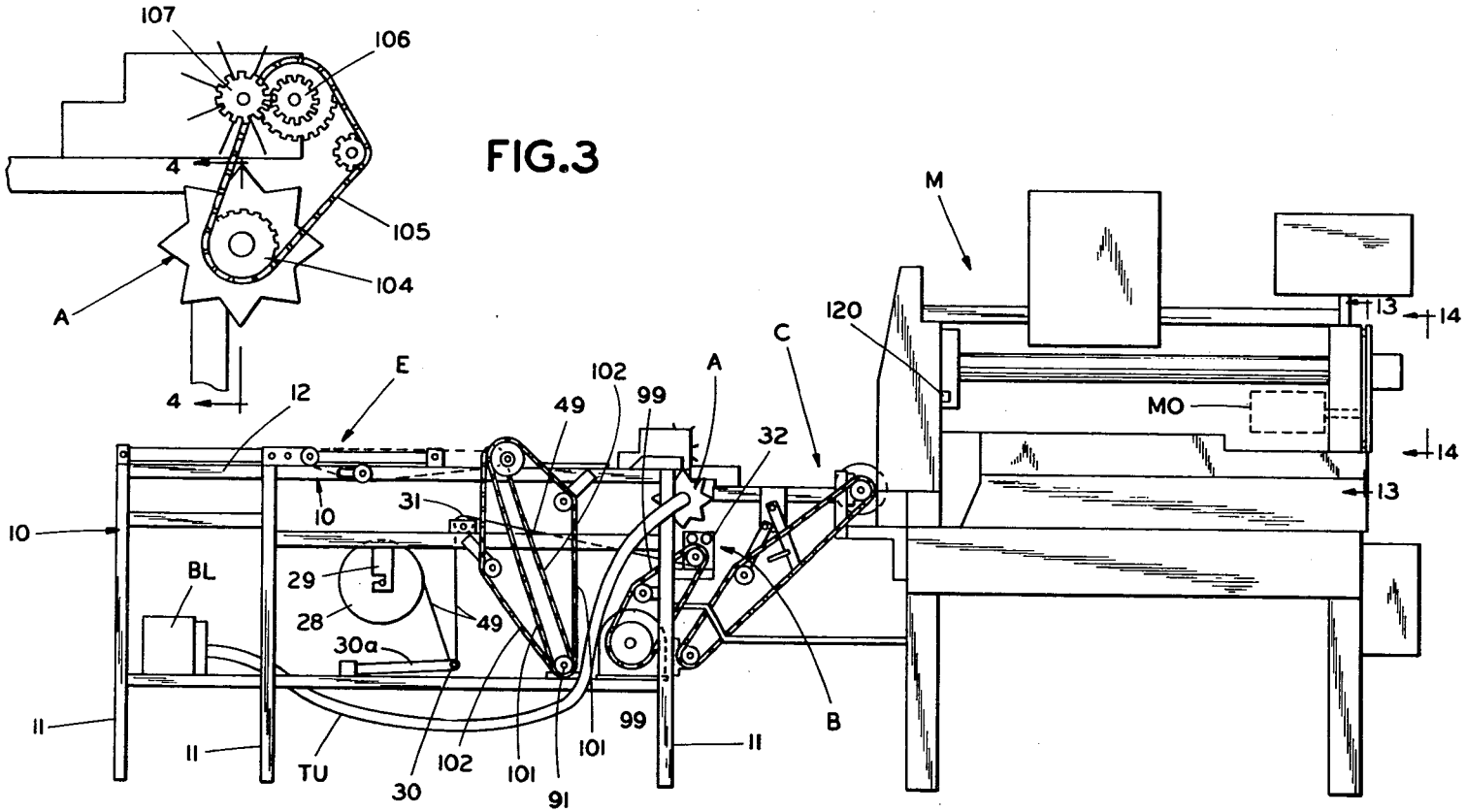
FIG. 1 is a view in side elevation of the improved machine.
Figure 2:
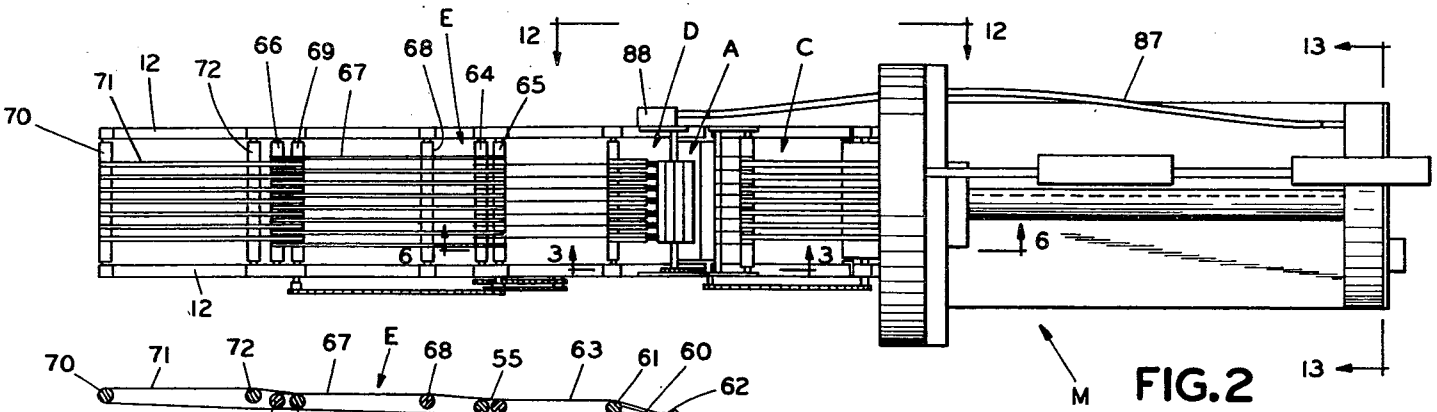
FIG. 2 is a plan view of the machine.
Figure 2A:
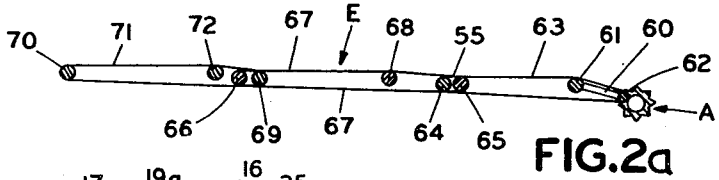
Figure 4:
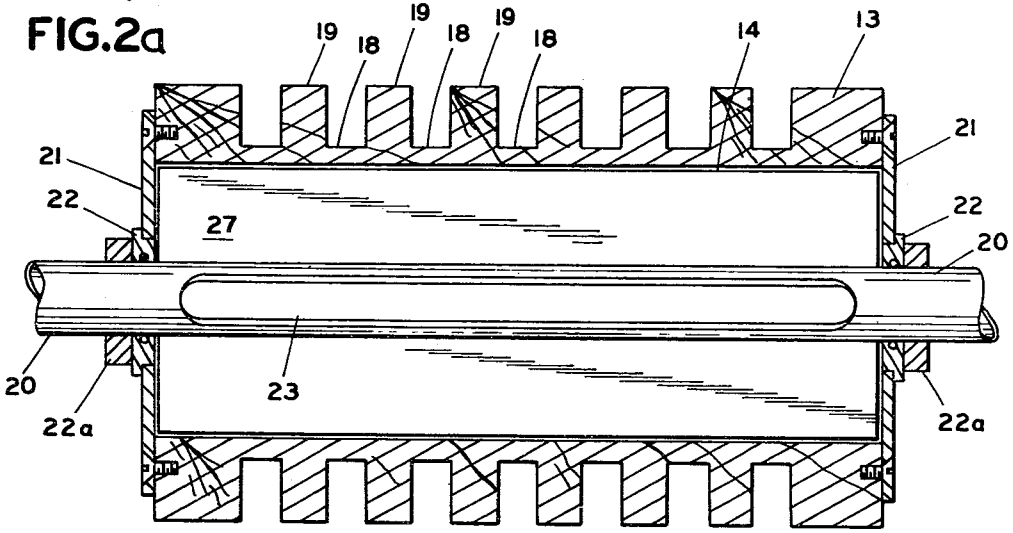
Figure 5:
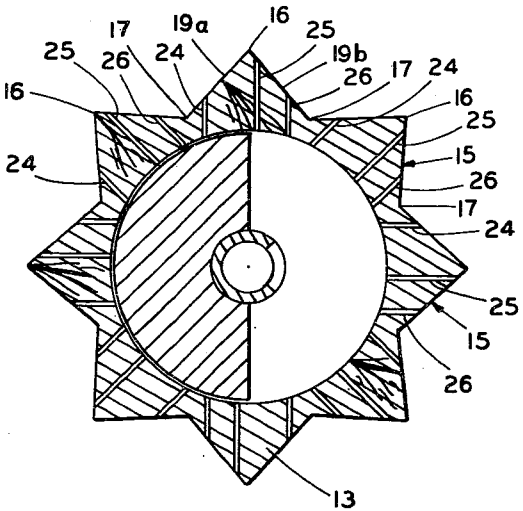
Figure 6:
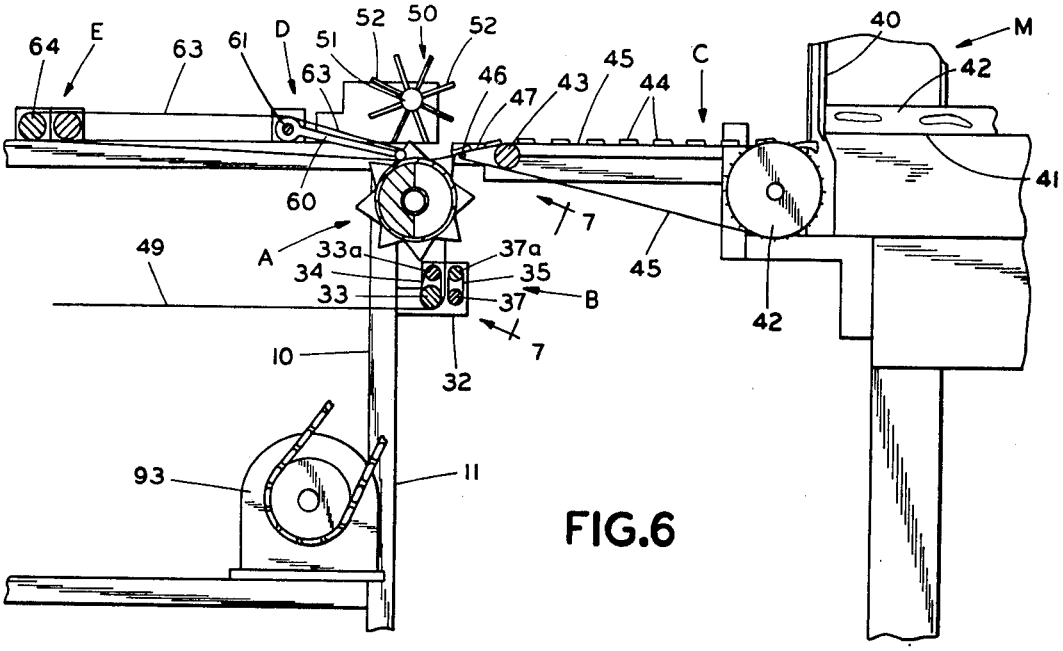
Figure 7:
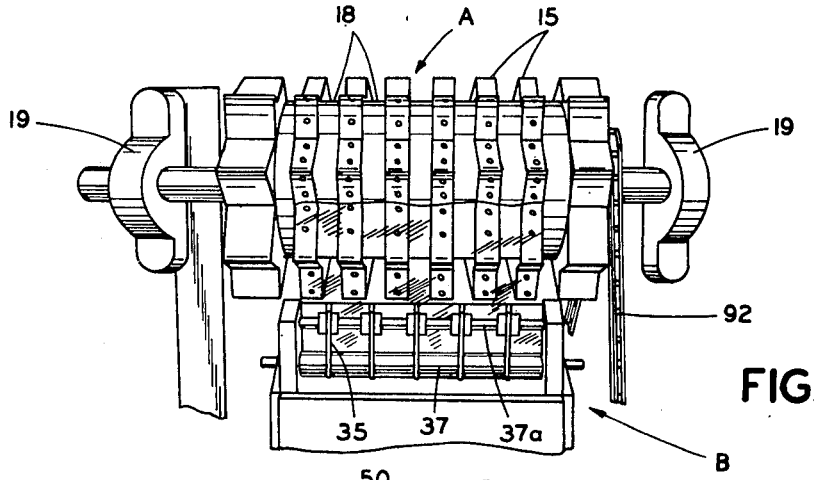
Figure 8:
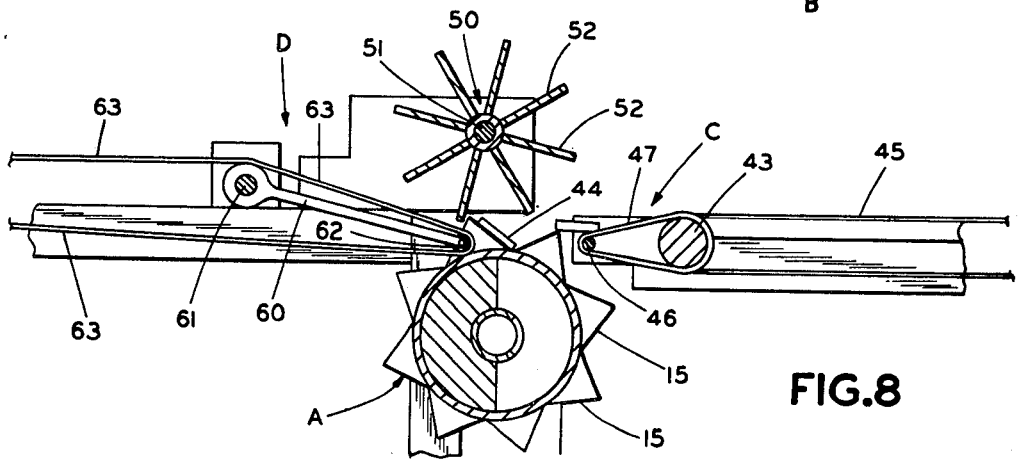
Figure 9:
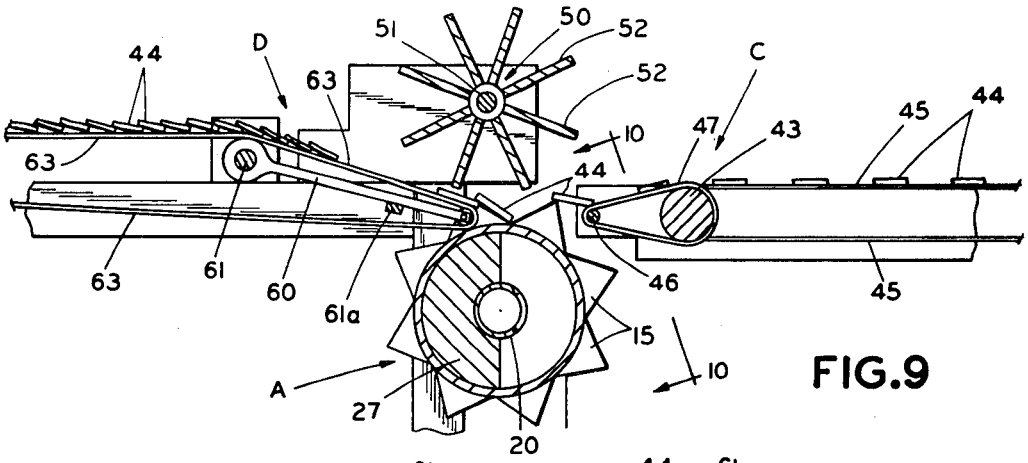
Figure 10:
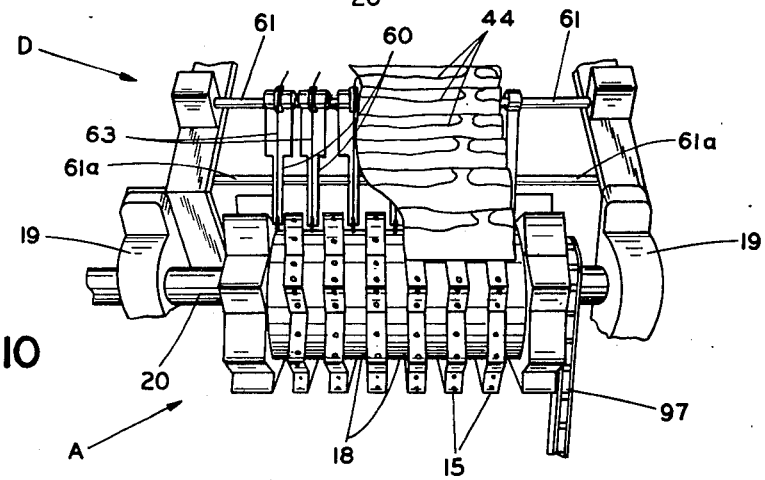
Figure 11:
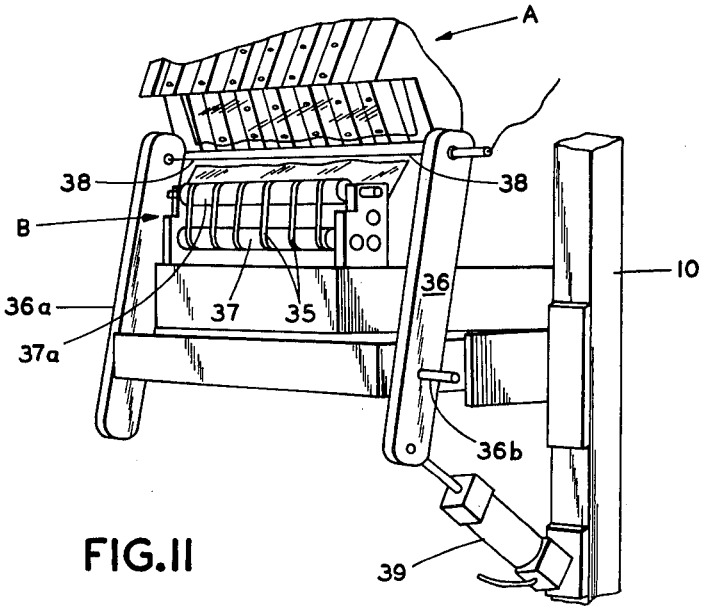
Figure 12:
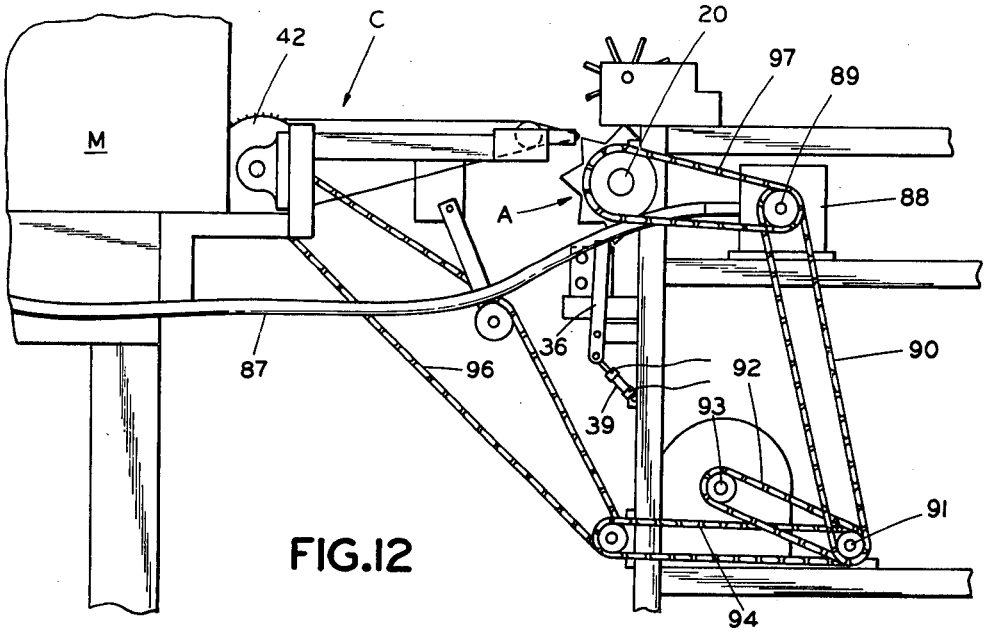
Figure 13:
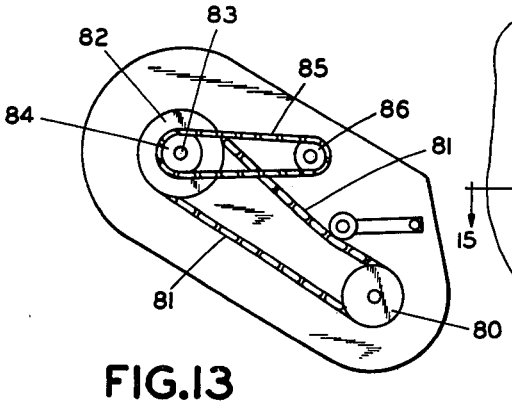
Figure 14:
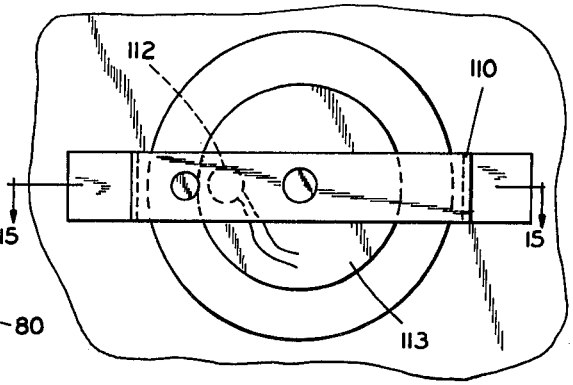
Figure 15:
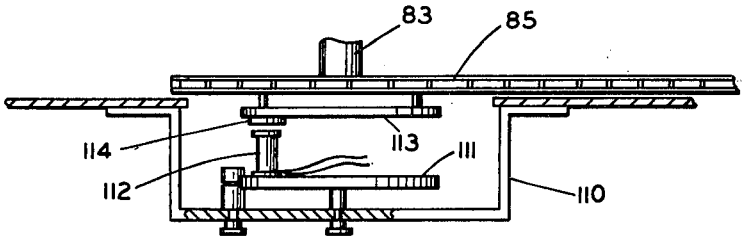
Figure 17:
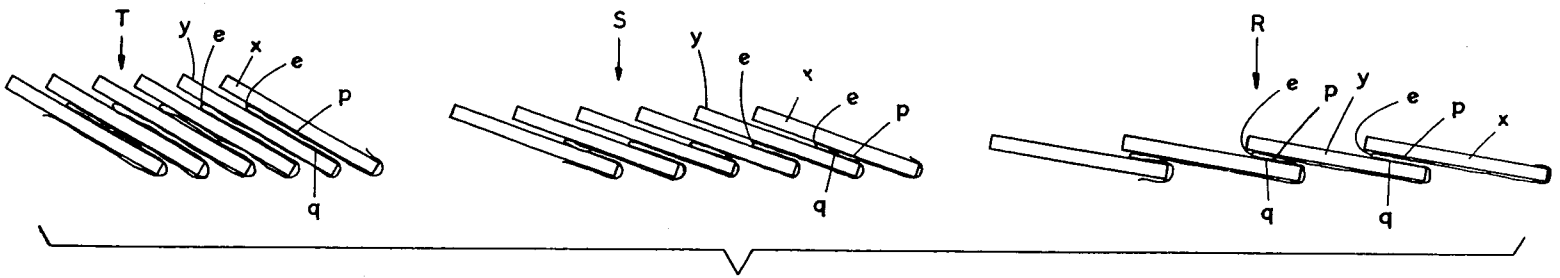
Figure 18:
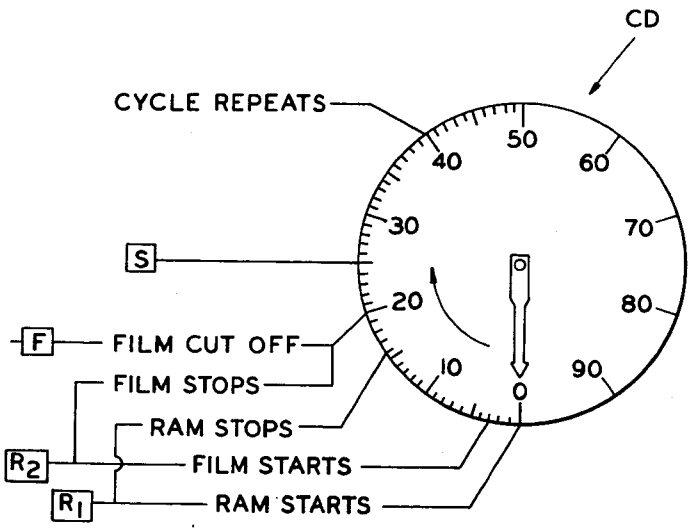
Figure 16:
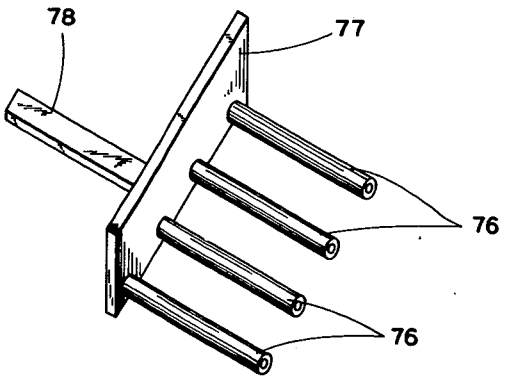
Figure 19:
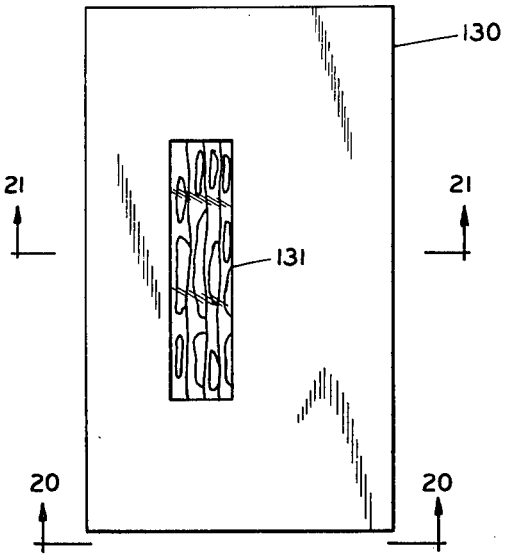
Figure 20:
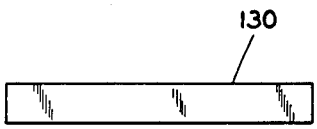
Figure 21:
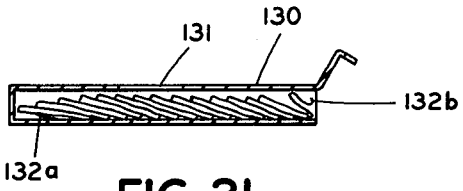
Figure 22:
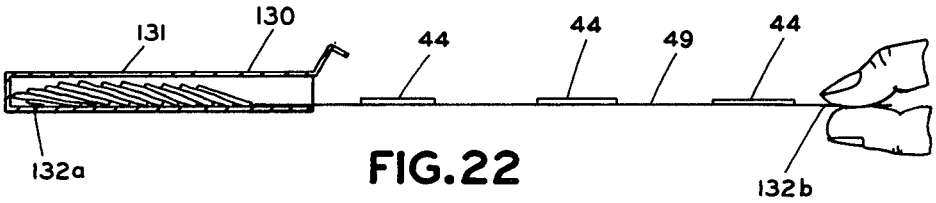
Figure 23:
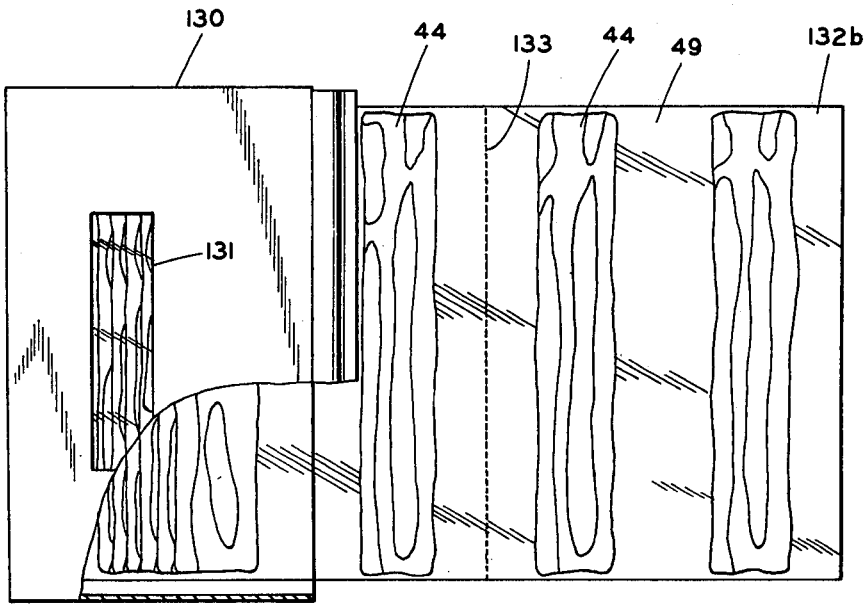

FIG. 2*a* is a schematic view in side elevation showing particularly the compacting mechanism;

FIG. 3 is a detailed view in elevation taken as seen from line 3—3 of FIG. 2;

FIG. 4 is an enlarged longitudinal sectional view of the stepped rotary member, the section being taken as seen from line 4—4 of FIG. 3;

FIG. 5 is an enlarged sectional view of the stepped roll, this section being taken transversely of the longitudinal axis of the roll;

FIG. 6 is an enlarged view partly in section showing in side elevation the stepped roll and the mechanisms for feeding this roll and for removing the interleaved slices from the roll, the view being taken at line 6—6 of FIG. 2;

FIG. 7 is a detailed perspective view showing the stepped roll and means for feeding the film material thereto, the view being taken as seen from line 7—7 of FIG. 6;

FIG. 8 is an enlarged view partly in section similar to FIG. 6 showing the stepped roll and showing the position of a slice which is in transition between the feeding mechanism and the rotary member;

FIG. 9 is a view like FIG. 8 but showing the slice after it has fallen into place on the stepped roll;

FIG. 10 is a perspective view of the stepped roll and the pick-up mechanism, the view being taken as seen from line 10—10 of FIG. 9, with the paddle wheel mechanism removed for purpose of illustration;

FIG. 11 is a detailed view in perspective of the mechanism for cutting the film material into desired lengths;

FIG. 12 is a view in side elevation showing the stepped roll and the feeding mechanism, the view being taken from the rear side which is the side opposite that of FIG. 1 as seen from line 12—12 of FIG. 2;

FIG. 13 is a detailed view in elevation showing the drive taken from the shaft of the slicer, the view being taken as seen from line 13—13 of FIG. 1;

FIG. 14 is a detailed view in elevation showing the mechanism for sensing the rotation of the slicer shaft;

FIG. 15 is a detailed sectional view of the sensing mechanism, the view being taken as seen from line 15—15 of FIG. 14;

FIG. 16 is a perspective view of a forked tool for removing the assembled strips from the machine;

FIG. 17 is a schematic view showing different stages of compaction of the strips being packed;

FIG. 18 is a schematic diagram of the electrical system for controlling the functioning of the machine;

FIG. 19 is a plan view of a package containing bacon in shingled relationship;

FIG. 20 is an end view of the package shown in FIG. 19, the view being taken as seen from line 20—20 of FIG. 19;

FIG. 21 is a sectional view of the package shown in FIGS. 19 and 20, the section being taken as seen from line 21—21 of FIG. 19, this view showing the package opened at one side;

FIG. 22 is a view like FIG. 21 but showing the slices of bacon being removed from the package; and FIG. 23 is a plan view of the package with part of the package being broken away to show the contents, and with slices being removed as shown in FIG. 22.

DETAILED DESCRIPTION

As illustrated, the improved machine includes a stepped roll A, mechanism B for delivering to the roll A a flexible film and for placing this film on the steps of roll A, mechanism C for delivering and placing the individual slices on the film while it is in place on the steps of roll A, pick-up mechanism D for picking up and removing the strips of material with films interleaved between the strips, and compacting mechanism E for removing the strips or slices of material together and into desired shingled or stacked relationship.

The mechanisms generally outlined above are mounted in a suitable frame 10 having legs 11 and side members 12 and are associated with a slicing machine M which may be a standard slicing machine modified, as will later be explained, to operate in synchronization with above mentioned mechanism of this invention.

The stepped roll A may be considered the focal center of the machine. This member is mounted transversely of the frame for rotation in a counter-clockwise direction as seen in FIG. 1. Its structure is more clearly seen in FIGS. 3 and 4. A principal part of this structure is the shell 13 which is hollow having the cylindrical interior surface 14. The outer surface of shell 13 has been cut out longitudinally to form what may be called steps 15 having high points 16 and low points 17 (see FIG. 3). The shell 13 is also cut out angularly to form spaced annular channels 18 (FIG. 4) which extend in depth to points which are radially closer to the axis of roll A than are the points 16 and preferably closer to the axis than the points 17. These annular channels divide the steps of shell 13 into what may be called teeth 19.

A pipe 20 is securely mounted in frame 10 by means of clamps 19 (FIG. 7). The shell 13 is rotatably carried on pipe 20 by means of end plates 21 in which bearings 22 are contained. Retainers **22*a*** hold the rotary member A in proper axial position.

The pipe 20 provides a conduit for the application of vacuum to the interior of the shell 13. It has an opening 23 through which air may be drawn from the interior of the shell, and passages 24 extend through the wall of the shell to connect the interior with the front side **19*a* of the teeth 19, and passages 25 and 26 connect the interior of shell 13 with the rear side 19*b* of teeth 19.**

Within shell 13 is a half cylindrical block 27 which is secured at its axis with the pipe 20 and so remains stationary while member A rotates. Note that block 27 is on the forward side of pipe 20 while the opening 23 connects with the rearward open area back of block 27.

The mechanism B for delivering portions of film material over roll A is best understood by reference to FIGS. 1, 6 and 11. A roll 28 of film material 49 is carried on brackets 29 mounted on frame 10. Film from roll 28 passes under roll 30 which is carried on pivotally mounted arms **30*a* and this roll serves to keep the film taut. The film then passes over positioning roller 31 and thence upwardly through the feeding device 32. The device 32 includes a pair of rolls 33 and 33*a*, 33 being a lower roll and 33*a* being just above it. Each of rolls 33 and 33*a* contain spaced annular grooves in which run the belts 34 made of rubber or suitable elastic material. Just to the rear of rolls 33 and 33*a* is a similar pair of rolls 37 and 37*a* also containing annular grooves and containing belts 35 similar to belts 34. Belts 34 and 35 are aligned and the pairs of rolls are spaced so that the film material may be passed upwardly between these pairs of rolls in a vertical plane, being gripped on both sides by the elastic belts 34 and 35.** The film may move upwardly along with the belts. By moving the film material upwardly in this fashion the film can be passed on to the rotary member A without wrinkling or misalignment.

As the end of the film reaches the steps 15 of the rotary member it is drawn tightly against these steps by vacuum drawn through pipe 20, opening 23 and passages 24, 25 and 26. The film moves along with member A as it rotates until the film reaches the angular position where the passages contained therein are blocked by member 27, at which point the film is released.

Mechanism is provided for cutting off the film in sequence with the delivery of slices, and this includes a pair of side arms 36 and **36*a* (FIG. 11) pivotally mounted in the frame and arranged to swing about their pivots 36*b*. A hot wire 38 extends from the top portion of arm 36 to the bottom portion of arm 36*a*, and the lower end of arm 36 (below the pivot) is connected through air cylinder 39 to a frame member. When the piston of cylinder 39 is extended this moves the hot wire 38 forwardly to sever the film, and when this piston of cylinder 39 is retracted this moves the hot wire 38 rearwardly to sever the film. It will be noted that the hot wire is positioned above the film feeding device 32, so that when the film is severed the end of the film being fed from roll 28 is still held between belts 34 and 35 and in position to be automatically fed onto rotary member A upon the operation of feeding device 32.**

The mechanism C, for feeding individual slices to the stepped roll, receives the slices from the rotary knife 40 of the slicer M (FIG. 6). The slicer has a bed 41 supporting a slab 42 of bacon which in the operation of the ram of the slicing machine is caused to move forwardly into the knife 40, and as slices 44 are made they fall down in spaced relation on a conveyor which includes the large roll 42 having spines to help keep the strips in place and includes a smaller roll 43. Extending about rolls 42 and 43 are the bands 45 on top of which the slices pass forwardly from the slicer.

Forwardly of roll 43 is a roller 46 which is relatively small in diameter, and extending about rolls 43 and 46 between belts 45 are the belts 47 which are circular in cross section and which carry the bacons strips forwardly to the end of the carriage just over the steps of member A which are rising up to meet the bacon. The belts 45 are preferably flat so as to hold the slices in proper position but the belts 47 are preferably circular in cross section to present a narrow edge to the bacon slices so that they can more easily be discharged over the roll 46 from the conveyor.

When one of the slices 44 reaches the end of the conveyor at roll 46 and the forward edge of the slice extends over the edge of the conveyor, the high point 16 of one of the steps 15 on member A comes up to contact this edge. Then, as illustrated particularly in FIG. 9, the forward edge of the slice rides forwardly on point 16 while the rearward edge of the slice moves forwardly over the edge of the conveyor, after which the rearward edge falls and the slice turns and comes down to rest flatly against the film on the rearward surface **19*b* of a step 15 with the rearward edge of the slice just over the low point 17.**

For reasons not clear to me I find in practice that occasionally a slice comes forward which tends to overshoot its position and falls forward of the high point 16 of the steps 15, and it is to take care of this occasion that I provide the paddle wheel 50. This wheel is mounted to rotate in the same direction as member A. It has a shaft 51 and paddles 52 extending radially of the shaft. This wheel is driven at a speed synchronized with member A so that as each slice comes forward to the point where it should fall down into place over the face **19*b* of a step 15 one of the paddles 52 will be there to block passage of the slice to an incorrect position on the fore side of the step 15.**

The mechanism D for picking up the slices with film material therebetween includes a set of spaced fingers 60 (see particularly FIGS. 9 and 10). These fingers are pivotally mounted at their base ends on a transverse rod 61 which is secured at its ends to the frame. Fingers 60 are movable angularly about rod 61 and rest on transverse baar 61*a* so that their ends can be accurately positioned to dip to the proper extent into the annular grooves 13 of member A. Small pulleys 62 are provided at the ends of the fingers and the belts 63, which preferably are circular in cross section, extend about pulleys 62 and a roll 64 which is mounted in frame 10.

The ends of fingers 60 extend under the film material and under the slices as they are delivered by the teeth 19 on the backside of the steps of member A, and as soon as the slice, resting on the film, comes down onto the belt 63 these belts take up the slices and the film on which they are resting and start to convey them forwardly but not so fast as they are being fed to the rotary member and are passing peripherally about member A. Consequently, the slices are stacked one over the other in shingled relationship but more or less loosely with the film doubled and disposed between the overlapping portions of the slices. The slices ride forwardly in this manner on the conveyor formed by belt 63.

Mechanism E involves conveyors of different speeds. Referring especially to FIGS. 2, 2*a*, and 17, the rolls 65 and 66, along with spaced belts 67, extending about the rolls, constitute a conveyor. Belts 67 extend in the spacing between the belts 63 but are to be driven at a slower rate of speed. Thus, when the bacon slices which are proceeding forwardly on belts 63 in the formation illustrated at R at the right hand of FIG. 17, they come to a position between rolls 65 and 64 where they are contacted by belts 67 which are running at a slower rate of speed. When the slices come into contact with belts 67 this tends to retard them while at the same time the belts 63 are pushing them forward. This tends to compace the slices pushing them closer together toward the formation S illustrated in the center of FIG. 17.

To promote the compacting function I provide the roll 68 which, as particularly shown in FIG. 2*a*, is mounted above rolls 64 and 65, and so that as the slices pass from belts 63 to belts 65 they are caused to move at an upward angle. This circumstance has been found to produce a compaction of the slices which is uniform and positive.

The belts 63 provide a top surface which is in a substantially horizontal plane. The belts 67 provide a top surface in a plane which is inclined upwardly from the plane of belts 63, and the planes of these two conveyors intersect at the line 55 in FIG. 2*a*. The bacon draft, in shingled form on belts 63 contacts the belts 67 at line 55 and from the moment of this contact until the most rearward slice of the bacon draft has passed from conveyor belts 63, the draft is being subjected to compaction.

I have further found that it is better to compact the slices in two or more steps rather than all in one operation, and so provide a second compacting conveyor arrangement including the rolls 69 and 70 and belts 71 which belts are disposed in the spaces between the belts 67. Further, I provide the roll 72 mounted above rolls 69 and 70 so as to provide an upwardly inclined surface on the top of belts 71 forwardly of the intersection between belts 67 and 71. Belts 71 are driven at a slower rate of speed than are belts 67, and there is again a compacting of slices as the slices pass from belts 67 to belts 71, as illustrated at the left hand formation which is designated T in FIG. 17.

Referring to FIG. 17, and the formations there illustrated, particularly to the slices designated *x* and *y*, the film which is doubled between these slices has a top portion *p* on one side of the double and a bottom portion *q* on the other side of the double, the edge of the double being designated *e*. In formation R the top portion *p* of the double extends over the bottom surface of slice *x* over substantially the whole width of the slice while the bottom portion *q* of the double extends over only about ⅓ of the width of slice *y*. As the slices are compacted a film portion *p* slides forwardly over the film portion *q*. The edge *e* moves forwardly with respect to slice *y* and may move rearwardly with respect to slice *x*. In formation T, the edge *e* is approaching the condition where portions *p* and *q* become equal and extend across about ⅔ or more of the surfaces of each of the slices *x* and *y*. I prefer that when compaction is complete the edge *e* of the double is short of the forward edge of either of slices *x* and *y* so that the film is hidden and does not show from the top of the draft.

The dimensions of the film between the slices as given above is a result of working with bacon having a width of approximately 1½ inches and having a distance of about 3 inches between a point 16 of one of the steps of the rotary member A, down one side 19*a*, and up the side 19*b* of an adjacent step to the next point 16 of the adjacent step. In this embodiment 1½ inches (the length of the film along face 19*a* of the steps 15) is taken up in the double (*p* and *q*) extending between the rear edge of one slice to the rear edge of the next slice.

If, for example, the slice to be packaged has a width of 4 inches and it is desired to have the interleaving film extend across substantially the whole width of the slice, then a stepped rotary member would be selected having a distance along the face of the steps between points of about 8 inches or somewhat more if the thickness of the slice is significant.

In the cases of bacon where the portion along the forward edge is quite lean and the portion along the rearward edge of the slice is fatty, it is sufficient to extend the interleaving film only to a point where it covers ½, ⅔ or ¾ of the width of the strip. This is so because it is the fatty portions of the slices which tend to make them adhere, and when the fatty portions of the slices are separated by the film the sticking problem is taken care of.

As is apparent from the foregoing explanation, it is possible to provide for the packaging of slices having different widths and different thicknesses, and to cause the interleaving film to cover a greater or lesser proportion of the width of the slices.

It is also possible to assemble the slices in vertical stacked form instead of the shingled formation illustrated in formation T of FIG. 17.

When it is desired to remove the slices in shingled arrangement the slices may be removed from the machine as they pass on belts 71 after they leave roller 72. Desirably, the operator may utilize the tool shown in FIG. 16 of the drawing. This tool is a forked structure having spaced prongs 76 attached to a back 77 having the handle 78. The prongs are in fact rollers and are mounted on the back piece 77 so as to be free to roll about their axes.

In using this tool the operator inserts the prongs 76 in a rearward direction between belts 71, and when a series of slices passes over the prongs, the operator raises the tool to lift the bacon in shingled arrangement. When the operator is ready to deposit the assembled bacon he may simply tilt the tool to one side of the other and the bacon will roll off the tool.

If it is desired to recover the bacon strips not in shingled formation but in vertically stacked relationship, the operator may simply hold the tool in position with its prongs between the belts 71 until the movement of the belts 71 have pushed the slices completely into line against the back of the tool and then raise the bacon draft with the slices in vertically stacked relation.

The mechanisms above described are synchronized with the slicing machine and with each other by a system of mechanical drives which are powered by a common source. An electric motor MO is mounted on the slicing machine (on the far side as seen in FIG. 1) and drives the gear 80 (FIG. 13) which through chain 81 and gear 82 drives the main shaft 83 of the slicing machine. Gear 84 on shaft 83 through chain 85 drives gear 86 of the flexible shaft device 87 (FIG. 2) which extends to the gear box 88. Shaft 89 from the gear box 88 (FIG. 12), through chain 90, drives shaft 91, and shaft 91 through chain 92 drives the clutch-brake device 93. Shaft 91 also, through chain 94, drives shaft 95 which, in turn, through chain 96 drives roll 42 of the feeding mechanism C.

Shaft 89 also, through chain 97, drives the gear 98, which is secured to the bearing of the rotary member A, and therefore drives this member is rotary movement about pipe 20.

The clutch-brake device 93 is set to brake position except when in response to an electrical connection it comes into drive position which permits the drive to be transmitted and through chain 99 drives the roll 33 of the film feeding device.

Shaft 91, through chain 101, drives roll 65, and shaft 91 also drives roll 65 through chain 102. The shaft of roll 65 is connected through chain 103 with the shaft of roll 69, and in this way drives roll 69.

Reffering to FIG. 3, the gear 104, which is secured to the end plate of member A, through chain 105 drives the gear 106, which is meshed with gear 107 which is connected with the shaft 51 of the paddle wheel 50, and so drives this paddle wheel.

The drive ratios are such that as slicer blade 40 releases slices of bacon onto the wheel 42 and belts 45, the slices lay in transverse, spaced-apart relation. For example, about 2 inches apart, and pass in this condition to a point over rotary member A. The rotary member A is driven at a rate such as to bring up successive steps 15 of this member so that the tip 16 of each step will contact the edge portion of successive strips as they come to the foremost end of the belts 47 of the feeding mechanism. Roll A is rotated the angular distance between its steps for each slice of bacon delivered over the edge of belts 47. The paddle wheel, also, is rotated the angular distance between paddles for each slice of bacon delivered to the stepped roll A. Roller 64 and belts 63 are driven to move belts 63 at a linear speed which is slower than the linear speeds of belts 45 and 47 of the feeding mechanism — enough slower to cause the strips on belts 64 to come together and to overlap tp a desired extent, which may be a little or much, up to the condition where the slices are aligned and in fully stacked condition.

Belts 67 are geared to run at a slower linear speed than belts 63, and belts 71 are geared to run at a slower linear speed than are belts 67 in the manner previously explained, so as to bring the slices together in the desired shingled or stacked relationship.

In the foregoing explanation it has been stated that rolls and conveyors run at certain prescribed or reference speeds and others run slower or faster, and that the mechanisms are driven to perform their functions in synchronization or in sequence with other functions. The drives for achieving this may be accomplished by having larger or smaller gears with fewer or greater number of teeth so as to accomplish the desired relative speeds, as well understood in the mechanical arts.

Normally, each revolution of the slicer blade 40 produces a slice of bacon. In some slicing machines two or more slices are produced by each revolution of the blade, but in any event the revolutions made by the slicer shaft make a good measure of the number of slices being passed through the machine, and as shown particularly in FIGS. 14 and 15 I provide means for sensing the revolutions of the slicer shaft and therefore the slices which are passed forward in the machine. The housing 110 at the end of the slicer machine carries on its interior a plate 111 to which a coil 112 is mounted. The plate 113, arranged to rotate with slicer shaft 83, has mounted thereon a permanent magnet 114, and upon each revolution of shaft 83 the magnet 114 is passed in proximity to the coil. This causes an electrical signal to be generated and fed to the electrical control device functionally illustrated in FIG. 18.

OPERATION

The operation of the improved machine willl be explained with reference to the control device which is illustrated functionally in FIG. 18.

Let us assume that the motor MO has been started, the drive shaft 84 and blade 40 of the slicer are in rotation, roll 42 is in rotation and belts 45 and 47 are in motion. Stepped member A and paddle wheel 50 are in rotation, and belts 63, 67 and 71 are in motion; the blower BL has been started and is drawing air through passages 24, 25 and 26 through pupe 20 and tube TU; the film from roll 28 has been threaded upwardly through feeding device 32 but the clutch-brake device 93 is locked. The film is not moving. The bacon slab 42 is in place next to the slicing knife with the lean slice up, but the ram which presses the bacon slab along bed 41 into the knife, is not engaged and therefore no slicing is taking place.

Referring now to FIG. 18, the signal generator S, shown at the left of the figure, represents the coil and permanent magnet device mechanically illustrated in FIGS. 14 and 15 and the pulses so generated are transmitted to the counting device CD, shown in FIG. 18 which has a circular dial graduated into 100 points and arranged so that each pulse generated moves the device one point, thus the device counts the revolutions of the slicer knife and it is possible to include 100 revolutions in one cycle.

We have assumed that the slicer shaft is in operation so this means that the signals are being delivered to the device CD and that the device is in operation, but control is not being performed by it until the operator presses the switch 120 located on the slicer, which operates to cut in the control function.

When, after switch 120 is thrown, the device CD next comes to point *o* (which may be indicative of the reference revolution), it operates relay $R_1$ to bring the ram of the slicer into engagement so that it starts to push the bacon slab into the slicer blade resulting in slices of bacon being delivered to the conveyor 45 with each slice being spaced from the other slices.

It is necessary that the film reach the stepped roll A before slices of bacon reach this roll, but since the film is closer to the stepped roll than is the bacon when sliced the time when the film feed begins may be delayed somewhat and in the exemplary setting of device CD shown in FIG. 18 the relay $R_2$ is actuated at point 3 which releases the clutch-brake device 93 and begins feeding of the film. When the device CD reaches point 16 relay $R_1$ is released and the ram of the slicer is disengaged which stops delivery of slices after 16 slices have been delivered to the machine. When device CD reaches point 20 relay $R_2$ is released which causes the clutch-brake device 93 to lock, thus stopping the feeding of the film.

At the same time, when device CD comes to point 20 it actuates a flip-flop air switch F to operate air cylinder 39. If the piston of this cylinder is extended, the flip-flop switch moves to send air to the cylinder 39 at the rod end to move the hot wire 38 in one direction across the film 49, and so severs the film squarely. If the piston of cylinder 39 is retracted the operation then is to extend the piston to move the hot wire in the other direction across the film and so sever the film. With this operation the hot wire moves only once across the path of the film and makes a clean cut.

In setting the control device to accomplish the function above referred to, the connections for starting and stopping the slicer ram and for starting and stopping the film feed may each be put at points removed a selected number of slicer revolutions from the reference point *o* — maybe at the point *o* itself or any particular revolution thereafter up to the last revolution in the cycle, and the end of the cycle itself may be set on a revolution point up to the capacity of the device CD.

After the slicer has delivered the draft of 16 slices (or whatever number of slices has been selected for a draft) and the draft of the selected number of slices continues over the roll A where the slices are interleaved by film and put in shingled formation, and are thence put over the mechanism E where they are compacted, and then are finally removed from the machine.

The device CD continues to move to the next adjacent point when each continuing revolution of the slicer knife takes place, and when it arrives at point 40, the device is set to reset itself at *o* position to start a new cycle, beginning with starting of the slicer ram.

It should be understood that the settings of the device CD above referred to are exemplary only and that this device can be set to perform the respective functions in any desired revolution of the slicer within the cycle, and the cycle itself may be enlarged or decreased simply by adjusting the point at which the control device is set to being a new cycle.

With the type of control above described any number of slices up to the capacity of the control device can be put in each draft of bacon slices, and the end portion of the film for each draft may be regulated as long as may be desired on each side of the draft, and also the drafts may be spaced as desired. In the example above given the free space between bacon drafts is set to be about the same as the length of the draft itself, but this can be adjusted as desired merely by adjusting the setting of device CD.

In the foregoing description the invention has been described in connection with the packing of bacon slices, but it should be understood that this method and machine are extremely well adapted for use in the packing of slices of luncheon meats, cheese, sausages or any food to be distributed or sold in sliced form. The machine may in fact be used in packaging strip material of any kind where there is any problem of the strips sticking together.

FIGS. 19 and 20 show a package of bacon which is like the ordinary commercial package except for the interleaved bacon contained therein. The interleaving need not show through the window 131 of the carton 130, the interleaving being hidden between the slices.

FIG. 21 is in cross section and shows the film having a short forward end 132*a* and a longer rearward end 132*b* which can be grasped by opening the side of carton 130 and pulling out the end of the film 132*b* as shown in FIGS. 22 and 23 to bring the slices out consecutively in spaced relation on the film 49. Since the slices may be easily removed from the package, it is not necessary to provide a tray to be pulled from the package as is customarily done in the prior art commercial practice.

I prefer to use film which has been perforated at transverse lines 133 at intervals spaced along its length. The perforations may be, for example, every 6 inches along the length of the film. Thus the perforations may come about every third slice of bacon. When the film with slices of bacon thereon has been pulled out and the desired number of slices removed, the excess film may be severed along the perforated line and the separated film discarded. Conveniently then the loose end of the film remaining can be tucked into the carton and the carton reclosed and stored for future use.

While in the foregoing detailed description only one embodiment of the machine has been illustrated and described it is understood that the invention is subject to wide variations in structure and many changes may be made in the structure and many modifications may be constructed, all within the spirit of the invention and embraced by the appended claims.

What is claimed is:

1. In a machine for packing strips of material comprising a roll having steps on the surface thereof, said steps each having a forward side, a high point, and a rearward side, means for rotating said rolls so that the top of said roll moves in a direction forward of said machine and means for passing film over said roll in conformity with said steps while said roll is rotating, the improvement which includes a conveyor, said strips being in spaced relation on said conveyor, and in which said conveyor constitutes means for supporting, transporting and delivering separate strips of said material consecutively in said forward direction toward said roll until each of said strips is contacted by a high point of one of said steps which is coated by said film, whereby upon continued rotation of said roll each of said strips is brought in succession to rest on the film over the rear side of one of said steps.

2. A machine as set forth in claim 1 in which said conveyor includes a plurality of rolls and provides above said conveyor rolls a support for said strips, and in which the one of said plurality of rolls which is nearest said stepped roll is smaller in diameter than another of said plurality of rolls.

3. In a machine for packing strips of material comprising a roll having steps on the surface thereof, said roll having an annular channel in its surface, means for passing film over said roll in conformity with said steps and means for supporting and delivering said strips forwardly of said machine to said stepped roll, the improvement comprising means for picking up film and strips of material from said stepped roll, said last-mentioned means including s finger member extending into said channel to a point radially below the high point of said steps, and a belt which is passed about the end of said finger member, said belt and said finger member being part of said means for picking up said strips from said roll.

4. A machine as set forth in claim 3 wherein said last mentioned means is operable to pick up and remove said strips from said roll in shingled relationship.

5. A machine as set forth in claim 3 wherein said stepped roll includes a plurality of said channels which are spaced longitudinally of said stepped roll, and which includes a plurality of said belts and finger members, the tops of said belts providing a support on which said film and strips may rest in passing from said stepped roll.

6. A machine as set forth in claim 3 wherein said finger member is pivotally mounted for movement about a horizontal axis, and a bar extending horizontally under said finger member to supports and positions said member.

7. A machine as set forth in claim 3 wherein said last mentioned means is operable to pick up and remove said strips from said roll in shingled relationship.

8. In a machine for packing strips of material comprising a roll having steps on the surface thereof, said roll having an annular channel in its surface, means for passing film over said roll in conformity with said steps and means for supporting and delivering said strips forwardly of said machine to said stepped roll, the improvement comprising means for picking up film and strips of material from said stepped roll, said last mentioned means including a belt which is extended into said channel and which when in motion contacts the underside of said film to lift said film and a strip thereon from said roll.

9. In a machine for packing strips of material comprising a roll having steps on the surface thereof, said steps each having a forward side, a high point and a rearward side, means for rotating said roll so that the top of said roll moves in a direction forward of said machine, means for passing film over said roll in conformity with said steps while said roll is rotating, and a slicer for slicing said material into separate slices, the improvement which includes a conveyor, said strips being in spaced relation on said conveyor, and in which said conveyor constitutes means for receiving thereon slices from said slicer in separated form and for supporting, transporting and delivering said slices in said forward direction toward said roll until each of said slices is contacted consecutively by a high point of one of said steps which is coated by said film, whereby upon continued rotation of said roll each of said slices is brought in succession to rest on the film on the rear side of one of said steps.

* * * * *